United States Patent [19]

Wissmann et al.

[11] Patent Number: 4,919,091

[45] Date of Patent: Apr. 24, 1990

[54] IGNITION SWITCH ARRANGEMENT FOR AN INTERNAL COMBUSTION ENGINE HAVING AN ELECTRICAL IGNITION SYSTEM

[75] Inventors: Michael Wissmann, Schorndorf-Weiler; Harald Schleimann, Waiblingen; Jürgen Weber, Kernen, all of Fed. Rep. of Germany

[73] Assignee: Andreas Stihl, Waiblingen, Fed. Rep. of Germany

[21] Appl. No.: 369,135

[22] Filed: Jun. 21, 1989

[30] Foreign Application Priority Data

Jun. 29, 1988 [DE] Fed. Rep. of Germany ..... 3821958

[51] Int. Cl.[5] ..... F02D 37/02; F02P 3/04

[52] U.S. Cl. ..... 123/179 BG; 123/179 G; 123/198 DC

[58] Field of Search .... 123/179 BG, 179 G, 198 DC, 123/625, 630

[56] References Cited

U.S. PATENT DOCUMENTS

| | | | |
|---|---|---|---|
| 1,143,378 | 6/1915 | Fynn | 123/179 BG |
| 2,791,207 | 5/1957 | Rayniak | 123/198 DC |
| 2,935,977 | 5/1960 | Eberline | 123/198 DC |
| 4,079,708 | 3/1978 | Wieland et al. | 123/198 DC |
| 4,672,929 | 6/1987 | Wissmann et al. | 123/179 G |
| 4,773,362 | 9/1988 | Wissmann et al. | 123/179 G |

*Primary Examiner*—Andrew M. Dolinar
*Attorney, Agent, or Firm*—Walter Ottesen

[57] ABSTRACT

The invention relates to an ignition switch arrangement for an internal combustion engine having electrical ignition. Engines for handheld portable tools are for the most part equipped with magneto ignition and are switched by short circuiting the ignition coil for bringing the engine to standstill. The ignition switch arrangement of the invention includes an ignition switching unit which is switchable between an ignition-enabling position wherein the ignition is operative and an ignition-disabling position wherein the ignition is inoperative. According to the invention, a latching actuator having a latch latches the ignition switch unit in the ignition-disabling position when the latching actuator is in its latching position when the ignition switch unit is switched into the ignition-disabling position while the engine is running. The latch releases automatically when the engine coasts to standstill so that the ignition is automatically enabled for the next starting operation.

12 Claims, 4 Drawing Sheets

9
10
15
18a
21
18b
24
40
17
12
14
18c
23
22
25
X
25a
i
i
X
44
25b
19
29

25
27
44

IGNITION SWITCH ARRANGEMENT FOR AN INTERNAL COMBUSTION ENGINE HAVING AN ELECTRICAL IGNITION SYSTEM

FIELD OF THE INVENTION

The invention relates to an ignition switch arrangement for a manually startable internal combustion engine having an electrical ignition system such as for an internal combustion engine having magneto ignition and built into a motor-driven chain saw or the like.

BACKGROUND OF THE INVENTION

U.S. Pat. Nos. 4,672,929 and 4,773,362 disclose an internal combustion engine having an automatic starting arrangement which includes a pneumatic positioning member engaging the starter flap (choke flap) of the engine. The positioning member is connected via a check valve to the crankcase of the engine which is started manually. When the engine starts running, then the changing crankcase pressure is applied to the check valve so that only the negative pressure components are allowed to pass. The positioning member includes a bellows which is evacuated so that the positioning rod associated with the bellows pivots the starter flap into its no-choke at-rest position in which the intake channel is clear and the engine runs.

When the engine is switched off, then the under pressure in the bellows drops since the bellows is ventilated via a compensating line. The positioning rod returns and pivots the starter flap into its start position for the next starting attempt.

Such an internal combustion engine has an electrical ignition system which is a flywheel ignition or magneto ignition in motor-driven tools such as lawn mowers, motor-driven chain saws or the like. To bring the engine to standstill, the ignition coil is connected to ground while the engine is running so that the spark plug can no longer provide sparks because of the short circuit which has occurred and the engine coasts to standstill. This short circuiting of the ignition coil occurs mostly via an ignition switch which short circuits the ignition coil in its first position (the engine coasting to standstill) and which, in a second switching position, interrupts the short circuit (the engine runs).

In practice, it has been shown that the switch is brought into the correct switch position for switching off the internal combustion engine; however, the return switching into the start position (ignition-enabling position) often does not occur when starting the engine. For a start-up operation wherein the ignition is switched so that it is disabled, the start-up operation leads to an over enrichment of the mixture in the combustion chamber of the engine and this, in turn, leads to considerable difficulties in subsequent starting attempts with the ignition switched so that it is enabled. This is problematical especially with manually started internal combustion engines.

SUMMARY OF THE INVENTION

It is an object of the invention to provide an ignition switch arrangement for manually startable internal combustion engines equipped with an electrical ignition system wherein starting of the engine with the ignition system disabled is avoided.

The ignition switch arrangement of the invention is for manually started internal combustion engines equipped with an electrical ignition system. The ignition switch arrangement includes: a position member actuable in dependence upon the operating condition of the engine for movement between a first position at which the engine is not running and a second position at which the engine is running; an ignition switch unit switchable between an ignition-enabling position wherein the ignition system is operative and an ignition-disabling position wherein the ignition system is inoperative; a latching actuator connected to the positioning member for moving between an unlatching position and a latching position in correspondence to the movement of said positioning member between said first position and said second position; and, the latching actuator having latch means for latching the ignition switch unit in said ignition-disabling position when the latching actuator is in the latching position and when the ignition switch unit is switched into said ignition-disabling position.

The ignition switch unit is configured as a disabling switch and is only latched by the latch means in its "ignition-disabling position". This latching occurs only when the engine is running and therefore when the positioning member activated by the running engine has driven the latch means into the travel or actuating path of the ignition switch unit.

The latching actuator can be a lever pivotally connected to the positioning member and includes latch means in the form of a latching cam.

When the engine coasts to standstill, the positioning member is no longer activated and falls back into its first or rest position whereby the latching lever pivotally connected thereto returns to its unlatching position and takes the latch means out of the actuating path of the ignition switch unit. The latching condition of the ignition switch unit is lifted whereby the ignition switch unit likewise returns to its rest position in which the ignition system is switched in. As soon as the engine stands, the ignition system is automatically switched in again so that the engine is already switched for the next starting operation. The ignition switch arrangement according to the invention therefore defines a switch-off automatic which returns the ignition system again to its start readiness when the engine is at standstill.

The invention is suited especially for motor-driven chain saws equipped with internal combustion engines having magneto ignition. When working with a chain saw, the latter is often switched off and placed down for carrying out ancillary work. When starting the chain saw again, the operator need not consider the ignition switch at all since the engine-driven dependent latching arrangement assures that for each starting operation, the ignition switch will jump back into its initial position "ignition-enabling".

Pursuant to a further embodiment of the invention, the ignition switch unit includes a flexible contact spring which is pivotable about an axis against the action of a return spring and is in this way brought into contact engagement with a counter contact. The counter contact is advantageously fixedly mounted on a housing so that it is especially suited for connection to the voltage-carrying ignition coil. The contact spring is advantageously connected to ground via a metal grounding strap.

If a starter flap is provided for an internal combustion engine which has a positioning shaft which is adjusted in the sense of an opening of the starter flap by the positioning member, then the latching lever with its latching cam can be mounted on the positioning shaft so as to rotate therewith. In this way, it is possible to integrate the ignition switch arrangement according to the invention without a great many additional components.

The positioning member is advantageously configured as a pneumatic positioning member which is actuated by the negative or positive pressure in the crankcase of the engine. The crankcase inner pressure is a reliable parameter for the operational condition of the engine. It can also be advantageous to use another operational parameter such as the under pressure in the intake pipe. An electrical positioning member can also be utilized if the engine drives a generator or if the magneto ignition supplies sufficient energy.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
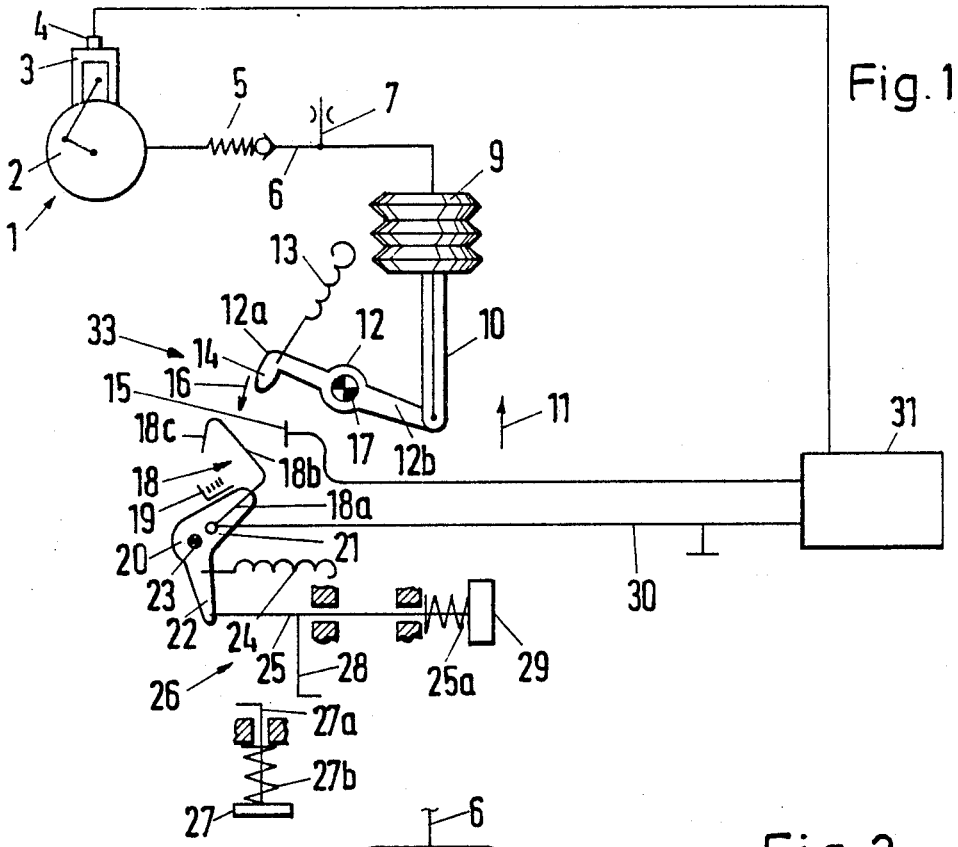
FIG. 1 is a schematic of the ignition switch arrangement according to the invention shown on an internal combustion engine equipped with magneto ignition.

The ignition switch arrangement 33 according to the invention includes primarily a contact spring 18 and a counter contact 15. The counter contact 15 is connected to the ignition coil of the ignition unit with the ignition coil and ignition unit being represented schematically by block 31. On the other hand, the contact spring 18 is at ground potential and a ground cable 30 is provided for this purpose.

The ignition unit 31 drives a spark plug 4 and advantageously includes a flywheel or magneto ignition. Such an ignition is characterized in that it delivers ignition energy only when the engine 1 is running with the energy discharging as an ignition spark at the spark plug 4 and igniting the combustion mixture in the combustion chamber 3. Such ignition units are utilized in tools such as motor-driven chain saws or the like since they have much less weight than battery ignition arrangements. The engine is most often started manually by means of a pullcord.

The crankcase 2 of the engine 1 is connected via a check valve 5 with a pneumatic positioning member 9. This connecting line 6 further has a branch line 7 in the form of a pressure-compensating line arranged between the check valve 5 and the positioning member 9. The branch line 7 includes a throttle 8. The positioning rod 10 of the positioning member 9 is pivotally connected to the end **12*b* of a latching lever 12 which is, in turn, pivotally journalled approximately at its center. The other free end 12*a* carries a latching cam 14. The latching cam 14 extends in the direction toward the contact spring 18 in the pivot plane of the latching lever 12. The contact spring 18 is arranged beneath the latching lever 12 and is connected with one end 18*a* to the leg 21 of a switching lever 20 configured as a bellcrank lever. Its other leg 22 lies opposite the actuator pin 25 of the push actuator 29. A spring 24 engages on the actuator leg 22 and pulls the bellcrank lever against a stop 19 which determines the rest position of the contact spring 18**.

Figure 2:
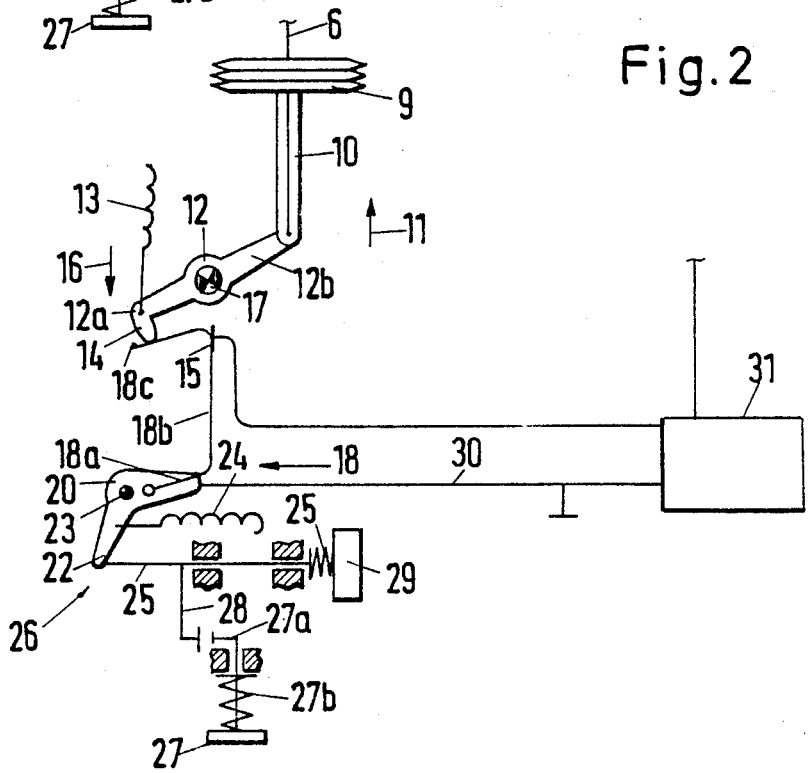
FIG. 2 is a schematic of the ignition switch arrangement of FIG. 1 with the ignition switch unit latched in its ignition-disabling position.

If the push actuator 29 is pushed down against the force of a spring **25*a* while the engine 1 is running, the actuator pin 25 strikes the leg 22 which pivots about the pivot axis 23. Correspondingly, the leg 21 pivots with the contact spring 18 whose contact segment 18*b* comes into contact engagement with the counter contact 15** fixedly mounted on the housing (FIG. 2).

Since the engine 1 is running, the negative components of the changing pressure present in the crankcase 2 has led to an evacuation of the pneumatic positioning member 9 whereby the positioning rod 10 is displaced in the positioning direction of arrow 11. In this way, the latching lever 12 is pivoted about the pivot axis 17 and the latching cam 14 is moved in the direction of arrow 16 whereby the latching cam 14 lies in the actuating path of the contact spring 18 of the switch 26. In this position, the latching cam 14 and a latching segment **18*c* of the contact spring 18 coact whereby the contact spring 18 and therewith the actuating lever 20 are latched in the disabled position when the push actuator is pressed downwardly. In the disabled position, the counter contact 15 is connected via the contact spring 18 to ground whereby the ignition unit 31, that is the ignition coil, is switched so that it is ineffective. This latched disable-position of the switch 26** is shown in FIG. 2.

The engine 1 coasts to standstill because of the absence of ignition. With the engine at standstill, a balanced pressure is present in the crankcase 2 so that the balancing operation takes place for ventilating the pneumatic positioning member via the throttle 8. In the pneumatic positioning member 9, the under pressure falls and the positioning rod 10 moves outwardly in a direction opposite to the direction of arrow 11. This return movement is supported by a tension spring 13 which engages the end **12*a* of the latching lever 12. With this return movement, the latching cam 14 moves opposite to the direction of arrow 16 and out of the travel path of the switch 26 and releases the latching segment 18*c* of the contact spring 18. Under the action of the tension spring 24, the switching lever 20 pivots back into its rest position at stop 19. The ground connection to contact 15 is interrupted and the ignition unit 31** is switched so as to be effective again.

By starting the engine by means of a pullcord, the ignition again receives electrical energy (magneto ignition) and the engine can start up since the short circuit of the ignition coil while bringing the engine to standstill is automatically lifted. This short circuit of the ignition coil is initiated and switched by the operator for the purpose of bringing the engine to standstill. With the start up of the engine, the pneumatic positioning member 9 is again evacuated whereby the latching cam 14 is pivoted into the travel path of the switch 26 for latching the contact spring 18 in its disabling position in the next stop operation.

Figure 3:
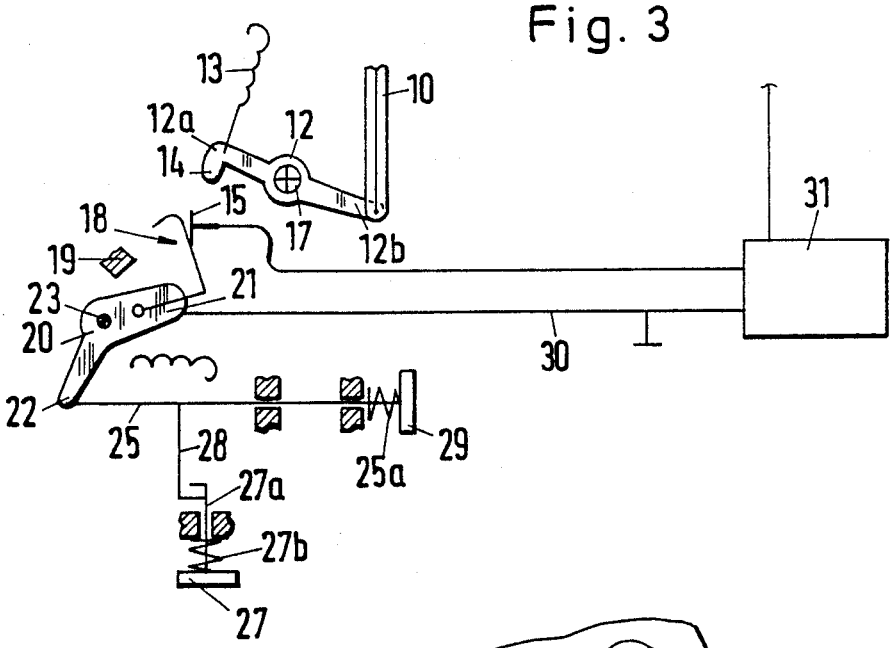
FIG. 3 is a schematic of the ignition switch arrangement of FIG. 1 showing the ignition switch unit releasably locked in its ignition-disabling position with the latching lever disposed in its unlatching position.
Figure 7:
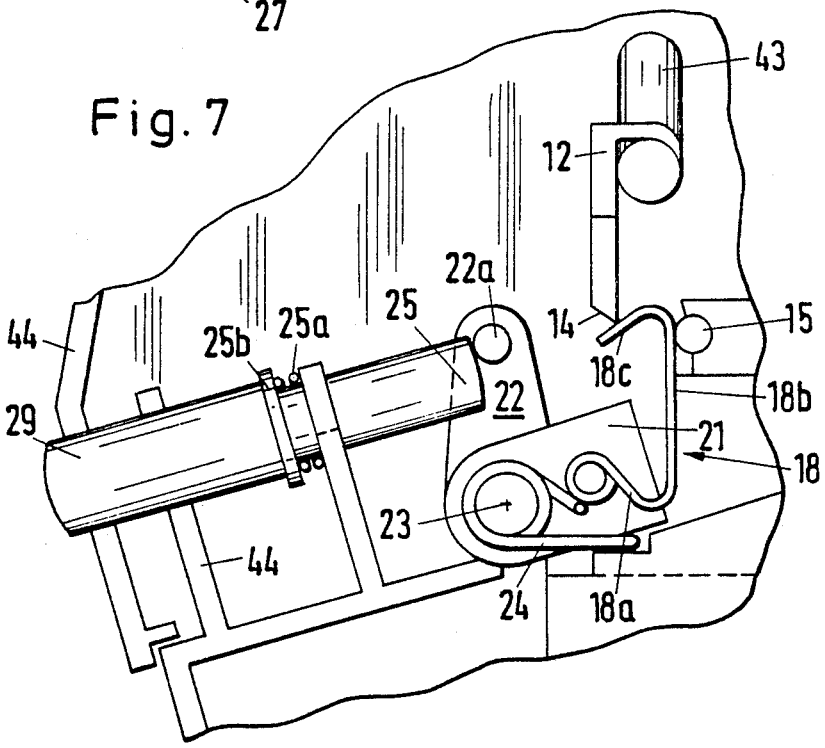
FIG. 7 shows the embodiment corresponding to that of FIG. 4 in the latched ignition-disabling position.

In order to ensure a continuous disablement of the ignition such as for repair work or the like, the actuator pin 25 is provided with a lateral locking arm 28 which, in the ignition-disabling position of the actuator 29, coacts with a locking pin 27*a* fixedly mounted on a housing. The locking pin 27*a* is displaceable into the actuating path of the locking arm 28 by means of an actuator 27 charged in its rest position with the pressure of a spring 27*b* (FIG. 1). As shown in FIG. 3, for locking the switch 26 in the ignition-disabling position, the push actuator 29 is pressed down and then the locking pin 27*a* is brought into the actuating path of the locking arm 28 by pressing down the locking button 27. If the push actuator 29 is released, then the spring 25*a* pushes the same back until the locking arm 28 lies against the locking pin 27*a*. The locking arm 28 and the locking pin 27*a* hook axially into one another so that the locking actuator 27 cannot travel back to its rest position because of the spring 27*b* whereby the lock would be released.

Figure 6:
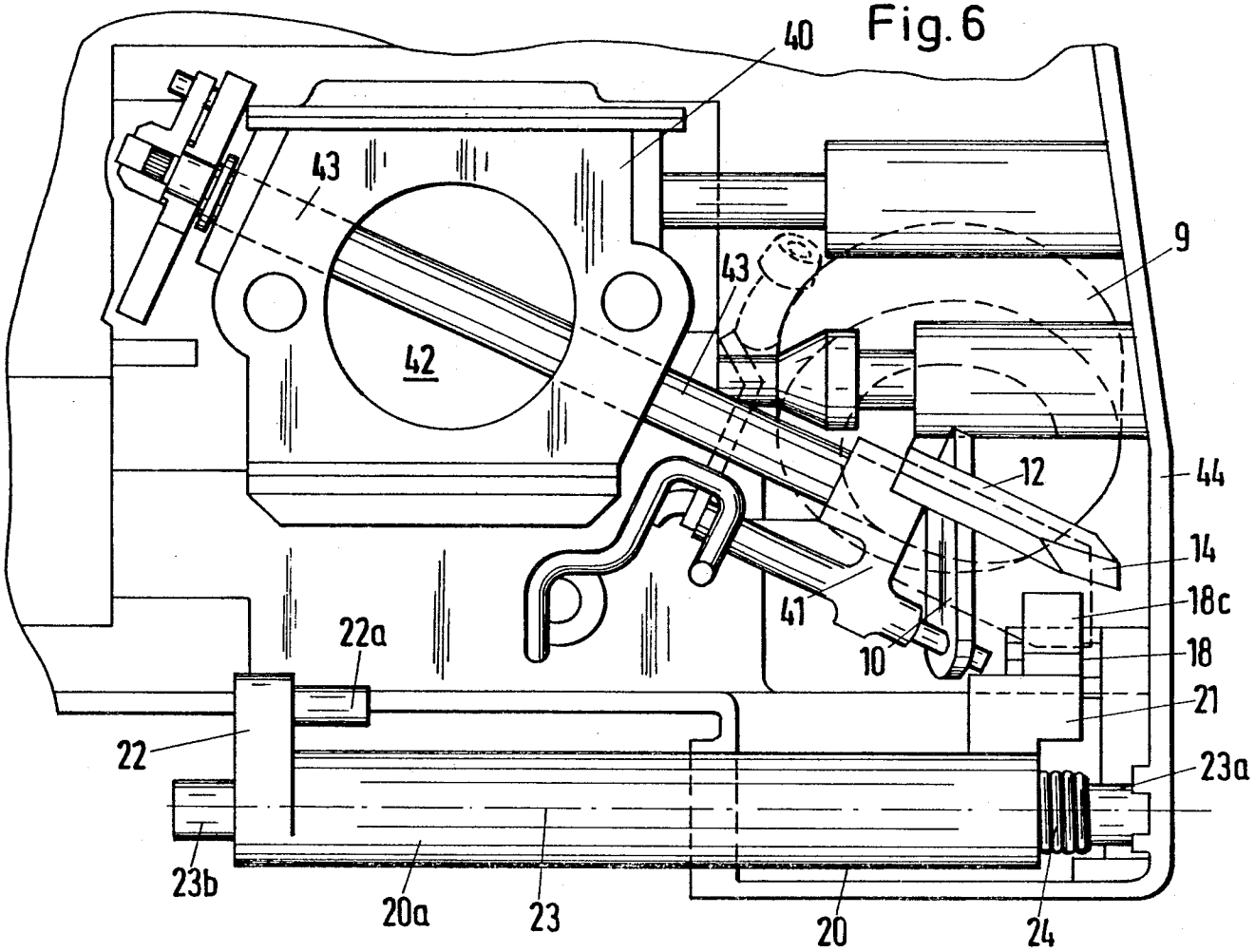
FIG. 6 is another view of the embodiment of FIG. 4.

In the embodiment of FIGS. 4 to 7, the pneumatic positioning member 9 is attached in the housing 44 of a motor-driven chain saw next to a carburetor 40. The positioning rod 10 engages a pivot lever 41 which is fixedly connected to a positioning shaft 43 carrying the starter flap 42. The positioning shaft 43 is rotatably journalled in the housing of the carburetor 40. As shown in FIG. 6, the latching lever 12 having the latching cam 14 is attached to the positioning shaft 43 and is preferably attached to the pivot lever 41 connecting the positioning shaft 43 to the positioning rod 10.

Figures 4, 5:
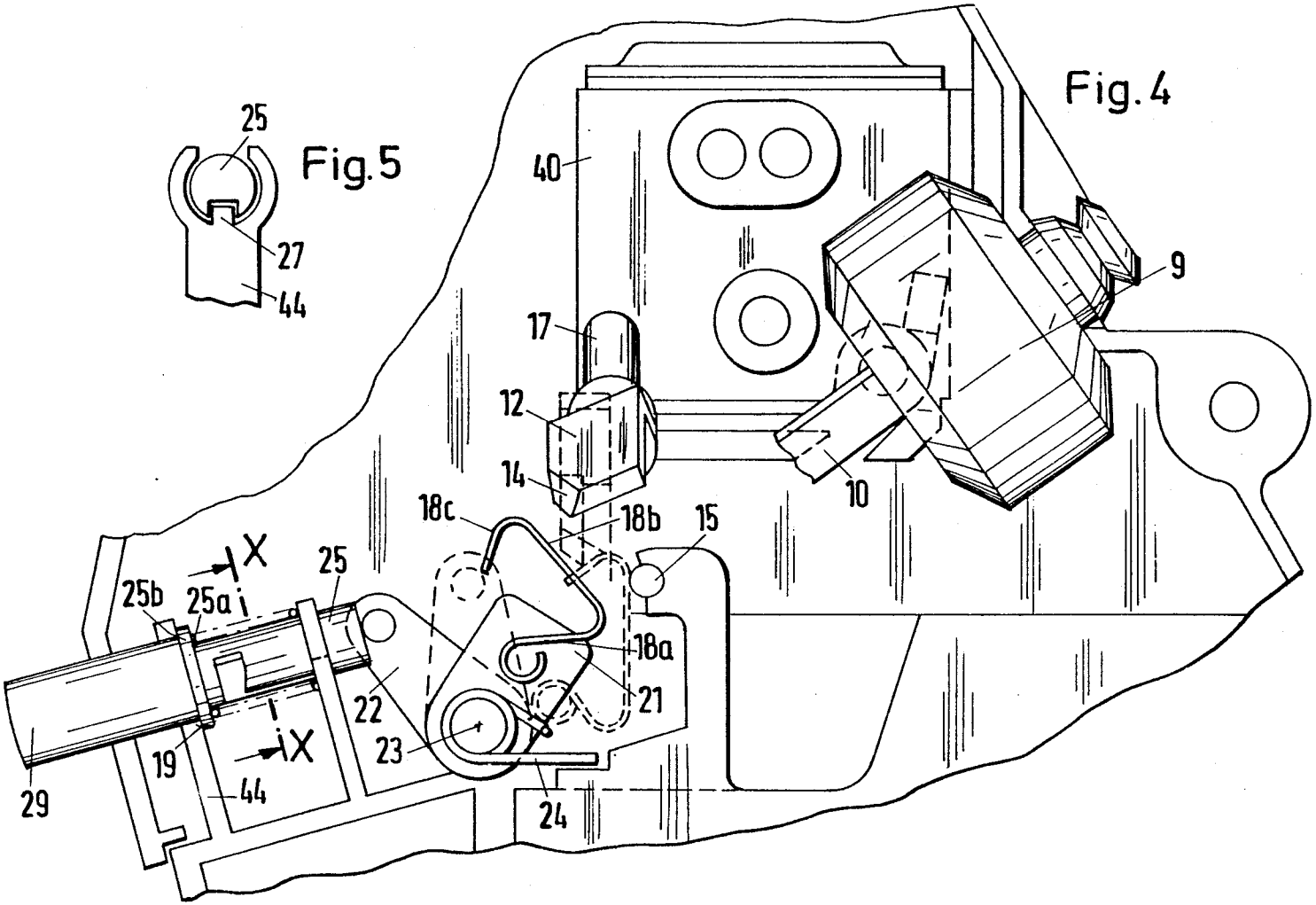
FIG. 4 is an embodiment of the ignition switch unit mounted in the housing of a motor-driven chain saw.
FIG. 5 is a section view, in schematic outline, taken along line X—X of FIG. 4.

The contact spring 18 of the ignition switch assembly 33 is arranged in the pivot region of the latching cam 14. The contact spring 18 has an end segment 18*a* which is attached to the leg 21 (FIG. 4) of the switching lever 20. In the embodiment of FIG. 4, the switching lever 20 includes a cylindrical tube 20*a* having respective ends in which corresponding ones of axial pins (23*a*, 23*b*) engage and hold the cylindrical tube 20*a* so as to be pivotable in the housing of the motor-driven chain saw. The pivot axis 23 of the switching lever 20 and the axis of the positioning shaft 43 lie at an acute angle to each other with the latchable ignition switch being arranged in the region of the imaginary point of intersection of the lines forming the acute angle. It can also be advantageous to arrange the pivot axis 23 and the axis of the positioning shaft 43 to be approximately or precisely parallel to each other.

At the one end of the tube 20*a*, the leg 21 of the switching lever 20 extends radially and is adapted to accommodate the contact spring 18 while the other leg 22 is disposed at the other end. The leg 22 likewise extends radially and lies, when viewed as in FIG. 6, at a spacing to the leg 21 so that a bellcrank lever results as best seen in FIG. 4.

At its free end, the leg 22 carries a round pin 22*a* which extends axially and lies parallel to the pivot axis 23 as shown in FIG. 6. This round pin 22*a* lies in contact engagement with the free end of the actuator pin 25 as shown in FIG. 4. The contact engagement is assured by means of the return spring 24 acting on the switching lever 20. The shoulder 25*b* is provided on the actuator pin 25 and lies against the housing 44 thereby defining the stop 19 shown in FIG. 4 and illustrated schematically in FIG. 1.

In the embodiment shown, the latching arrangement is integrated into the actuator pin 25 of the push actuator 29 as shown in FIG. 5. By rotating the push actuator 29 and therewith the actuator pin 25, the push actuator 29 can be latched in its depressed disabling position.

If the engine starts to run, then evacuation of the positioning member 9 leads to a pulling in of the positioning rod 10 whereby the starter flap 42 is pivoted into its open position. The operation of this automatic starting arrangement is disclosed in U.S. Pat. No. 4,672,929 incorporated herein by reference.

With the pivoting action of the starter flap 42 into its open position, the latching cam 14 is simultaneously pivoted into the actuating path of the ignition switch since the latching lever 12 is fixedly mounted on the positioning shaft 43 so as to rotate therewith. If the push actuator 29 is depressed, the latter actuates the switching lever 20 via the round pin 22*a* and pivots the contact spring 18 in the direction toward the counter contact 15. The latching segment 18*c* strikes the latching cam 14 whereupon the contact spring 18 yields elastically as a consequence of the further pivot movement until the latching segment 18*c* slips beneath the latching cam 14 and the contact segment 18*b* comes into electrically conducting contact engagement with counter contact 15.

If the push actuator 29 is now released, the actuator 29 returns under the action of spring 25*a* to its initial position (FIG. 4) in which the shoulder 25*b* lies on a holding flange fixed on the housing.

The ignition switch arrangement 33 remains in its latched position since the latching cam 14 prevents a return pivot of the pivot lever 21 with the contact spring 18. However, if the engine has coasted to standstill, the vacuum in the pneumatic positioning member is balanced and the positioning rod 10 travels back into its initial position while pivoting the positioning shaft with the throttle flap 42 and the latching lever 12. The latching lever pivoting back in this manner thereby releases the contact spring for return pivoting whereby the ignition switch arrangement 33 pivots under the action of return spring 24 into its initial position shown in FIG. 4. The ignition is then switched so as to be effective for the next starting operation.

It is understood that the foregoing description is that of the preferred embodiments of the invention and that various changes and modifications may be made thereto without departing from the spirit and scope of the invention as defined in the appended claims.

What is claimed is:

1. An ignition switch arrangement for a manually startable internal combustion engine equipped with an electrical ignition system, the ignition switch arrangement comprising:

a positioning member actuable in dependence upon the operating condition of the engine for movement between a first position at which the engine is not running and a second position at which the engine is running;

an ignition switch unit switchable between an ignition-enabling position wherein the ignition system is operative and an ignition-disabling position wherein the ignition system is inoperative;

a latching actuator connected to said positioning member for moving between an unlatching position and a latching position in correspondence to the movement of said positioning member between said first position and said second position; and, said latching actuator having latch means for latching said ignition switch unit in said ignition-disabling position when said latching actuator is in said latching position and when said ignition switch unit is switched into said ignition-disabling position.

2. The ignition switch arrangement of claim 1, comprising: a housing;

said ignition switch unit including: a switching actuator mounted on said housing so as to define a pivot axis and be pivotally movable between said ignition-enabling position and said ignition-disabling position; return spring means for biasing said switching actuator into said ignition-enabling position; an elastic contact spring electrically connected to said electrical ignition system and being mounted on said switching actuator so as to be movable about said pivot axis against the force of said spring means and through a travel path with the movement of said switching actuator from said ignition-enabling position to said ignition-disabling position; and, a counter contact electrically connected to said electrical ignition system and being mounted on said housing so as to receive said elastic spring contact in electrical contact engagement therewith when said switching actuator arrives at said ignition-disabling position thereby rendering said electrical ignition system inoperative; and, said latching actuator being a latching lever pivotally mounted on said housing for pivotally moving between said unlatching and latching positions; and, said latch means being disposed on said latching lever so as to be placed in said travel path when said latching lever is in said latching position for latching said elastic contact spring into electrical contact engagement with said counter contact until the engine comes to standstill.

3. The ignition switch of claim 2, said elastic contact spring being subdivided into three segments: an attachment segment for attaching said contact spring to said switching actuator; a contact segment for contact engaging said counter contact; and, a latching segment for latchingly engaging said latch means as long as said latching lever remains in said latching position.

4. The ignition switch of claim 3, said switching actuator being a switching lever having a first leg for holding said elastic contact spring at said attachment segment thereof; said switching lever having a second leg and a pivot location between said legs where said lever is pivotally mounted on said housing; and, said ignition switch unit further including a push actuator for acting on said second leg to pivot said switching lever against the force of said spring means and into said ignition-disabling position.

5. The ignition switch of claim 2, said electrical ignition system including an ignition coil; said counter contact being connected to ground and said contact spring being connected to said ignition coil whereby said ignition coil is short-circuited to ground when said contact spring comes into electrical contact engagement with said counter contact.

6. The ignition switch of claim 1, comprising: locking means for releasably locking said ignition switch unit in said ignition-disabling position.

7. The ignition switch of claim 1, the engine having a crankcase wherein under pressure develops during the operation of the engine; and, said positioning member being a pneumatic member connected to said crankcase so as to be charged by said under pressure.

8. A starting arrangement for a manually startable internal combustion engine equipped with an electrical ignition system and with a carburetor defining an intake channel through which air flows to the engine, the engine having a crankcase wherein under pressure develops during operation thereof, the starting arrangement comprising:

a starter flap;

a positioning shaft for pivotally mounting said starter flap in said intake channel so as to be movable from a start position to a no-choke at-rest position wherein the intake channel is clear;

a positioning member actuable in dependence upon the operating condition of the engine for movement between a first position at which the engine is not running and a second position at which the engine is running;

a pivot lever interconnecting said positioning member and said positioning shaft for rotating said starter flap from said start position to said no-choke at-rest position during operation of the engine and in correspondence to the movement of said positioning member between said first position and said second position;

an ignition switch unit switchable between an ignition-enabling position wherein the ignition system is operative and an ignition-disabling position wherein the ignition system is inoperative;

a latching actuator operatively connected to said positioning member for moving between an unlatching position and a latching position in correspondence to the movement of said positioning member between said first position and said second position; and, said latching actuator having latch means for latching said ignition switch unit in said ignition-disabling position when said latching actuator is in said latching position and when said ignition switch unit is switched into said ignition-disabling position.

9. The starting arrangement of claim 8, said latching actuator being a latching lever mounted on said positioning shaft.

10. The starting arrangement of claim 8, said latching actuator being a latching lever mounted on said pivot lever.

11. The starting arrangement of claim 8, said positioning shaft defining a positioning shaft axis; and, said ignition switch unit including: a switching actuator pivotally mounted so as to define a pivot axis and so as to be pivotally movable between said ignition-enabling position and said ignition-disabling position; said positioning shaft axis and said pivot axis intersecting at a predetermined location to define an acute angle; and, said ignition switching unit being disposed in the region of said location.

12. The starting arrangement of claim 8, said positioning member being a pneumatic member connected to said crankcase so as to be charged with said under pressure.

* * * * *

UNITED STATES PATENT AND TRADEMARK OFFICE

CERTIFICATE OF CORRECTION

PATENT NO. : 4,919,091

DATED : April 24, 1990

INVENTOR(S) : Michael Wissmann, Harald Schliemann and Jürgen Weber

It is certified that error appears in the above-identified patent and that said Letters Patent is hereby corrected as shown below:

On the title page, by "Inventors:": delete "Harald Schleimann" and substitute -- Harald Schliemann -- therefor.

In the "ABSTRACT", line 14: insert -- and -- between "position" and "when".

In column 1, lines 28 and 29: delete "under pressure" and substitute -- underpressure -- therefor.

In column 3, line 11: delete "under pressure" and substitute -- underpressure -- therefor.

In column 4, line 41: delete "under pressure" and substitute -- underpressure -- therefor.

UNITED STATES PATENT AND TRADEMARK OFFICE

CERTIFICATE OF CORRECTION

PATENT NO. : 4,919,091

DATED : April 24, 1990

INVENTOR(S) : Michael Wissmann, Harald Schliemann and Jürgen Weber

It is certified that error appears in the above-identified patent and that said Letters Patent is hereby corrected as shown below:

In column 7, line 61: delete "under pressure" and substitute -- underpressure -- therefor.

In column 8, line 2: delete "under pressure." and substitute -- underpressure. -- therefor.

In column 8, line 7: delete "under pressure" and substitute -- underpressure -- therefor.

In column 8, lines 60 and 61: delete "under pressure." and substitute -- underpressure. -- therefor.

Signed and Sealed this

Eleventh Day of June, 1991

*Attest:*

*Attesting Officer*

HARRY F. MANBECK, JR.

*Commissioner of Patents and Trademarks*